US005683007A

United States Patent [19]

Scholfield

[11] Patent Number: 5,683,007

[45] Date of Patent: Nov. 4, 1997

[54] CUP HAVING ANGLED HANDLE

[76] Inventor: Richard P. Scholfield, 4608 Eastlake Cir., Sarasota, Fla. 34232

[21] Appl. No.: 549,644

[22] Filed: Oct. 27, 1995

[51] Int. Cl.[6] ..... B65D 25/28

[52] U.S. Cl. ..... 220/755; 220/756; 220/771

[58] Field of Search ..... 220/703, 771, 220/753, 755, 756, 741, 742, 705, 710.5

[56] References Cited

U.S. PATENT DOCUMENTS

| | | | |
|---|---|---|---|
| D. 186,555 | 11/1959 | Hunt | 220/741 |
| D. 360,807 | 8/1995 | Scholfield . | |
| 1,118,794 | 11/1914 | O'Mara | 220/771 |
| 1,546,131 | 7/1925 | Hechler . | |
| 2,527,447 | 10/1950 | Perl . | |
| 2,540,306 | 2/1951 | Turek . | |
| 3,927,797 | 12/1975 | Flider . | |
| 4,561,560 | 12/1985 | Lyon | 220/703 |
| 5,312,014 | 5/1994 | Hamlin | 220/703 |
| 5,570,797 | 11/1996 | Yeh | 220/710.5 |

FOREIGN PATENT DOCUMENTS

| | | | |
|---|---|---|---|
| 245188 | 2/1966 | Austria | 220/771 |

OTHER PUBLICATIONS

Advertising brochure for "Imagineered Perfect Cup", Imagine It Corp., Copyright 1993 and 1994.

*Primary Examiner*—Stephen J. Castellano
*Attorney, Agent, or Firm*—Cushman Darby & Cushman IP Group of Pillsbury Madison & Sutro LLP

[57] ABSTRACT

A cup is provided including a generally cylindrical reservoir having top and bottom ends and a sidewall. The bottom end is defined and the top end defines an opening in the reservoir. A handle structure is affixed to the sidewall. The handle structure includes upper and lower portions fixed to and extending from the sidewall structure. A vertical portion extends between and joins the first and second portion. The handle structure also includes a substantially vertical plate affixed to the first and second portions so that the vertical plate is disposed therebetween, the vertical plate being disposed between the sidewall and the vertical portion such that a lateral distance from the vertical plate to the sidewall is less than a lateral distance from the vertical plate to the vertical member, so as to isolate the user's fingers from contact with the sidewall. The upper and lower portions are inclined from horizontal so as to facilitate gripping and maximize finger room in the handle.

20 Claims, 6 Drawing Sheets

CUP HAVING ANGLED HANDLE

BACKGROUND OF THE INVENTION

This invention relates to containers for housing a liquid at an elevated temperature, and more particularly, to a cup having an improved handle.

Conventional cups or mugs include a generally U-shaped handle having curved surfaces. The handle is typically arranged so each end of the handle extends directly from the sidewall surface of the cup and is spaced therefrom to enable the user's fingers to grip the handle. The handle is typically spaced from the cup in a manner such that a user's fingers may contact the outer surface of the cup while gripping the handle. However, typically, such cups contain liquid, such as coffee or tea, at an elevated temperature. Thus, when gripping the handle, the user may contact the hot outer surface of the cup and react by spilling the contents of the cup or not being able to conveniently hold the cup. The user may even receive a burn as a result of contacting the hot surface of the cup.

Conventional cup handles are typically of narrow width and are steeply curved, thereby making them difficult to grip and control in all directions, especially for those who are physically handicapped. For example, it is virtually impossible for persons having missing fingers or a missing thumb to grip and lift a conventional cup without spilling the contents thereof. Further, since a strong grip is required to hold a conventional cup by its handle, it is difficult for an arthritic person to use such a cup.

I have previously proposed a cup having an improved handle that addresses the above-noted problems. That cup and handle combination is disclosed in my prior co-pending Application No. 08/207,615, filed Mar. 9, 1994, the disclosure of which is incorporated herein by this reference. That cup advantageously isolates the user's fingers from the outer peripheral surface of the cup and, furthermore, can be easily gripped and lifted by physical challenged individuals without the cup spilling its contents. That is not to say, however, that improvement thereof is not possible and, indeed, the present invention is an improvement on my earlier handle configuration that further facilitates gripping and cup control, particularly by individuals who are physically challenged.

SUMMARY OF THE INVENTION

It is an object of the invention to provide a cup having a handle whereby a user's fingers may be isolated from the outer peripheral surface of the cup, while holding the cup. Another object of the invention is to provide a cup having a handle whereby users having physical handicaps may be able to easily grip and lift the cup without spilling its contents.

In accordance with the principles of the present invention, these objectives are obtained by providing a cup including a main body having bottom and top ends and an interconnecting sidewall structure. A handle structure is affixed to the main body. The handle structure includes upper and lower handle mount portions fixed to the sidewall of the main body so as to extend outwardly therefrom. The upper handle mount is inclined with respect to horizontal so as to extend upwardly away from the main body. The lower handle mount is also preferably inclined, but so as to extend downwardly away from the main body.

A generally vertical portion extends between and joins the upper and lower handle mount portions. Further, a plate member is provided that is fixed to at least one of the upper and lower handle mounts to extend generally vertically along at least a substantial portion of a distance between the upper and lower handle mount portions. The plate member is spaced from the sidewall structure. Finally, a generally horizontal plate element is coupled to and extends between the plate member and the vertical portion.

In accordance with another aspect of the invention, a cover/coaster member is provided for engaging at least one end of a cup. The cover/coaster member includes a base, a portion extending from the base having an open end, an inner periphery of the portion of the cover member being larger than an outer periphery of the cup so that at least a part of the cup may be received in the portion of the cover member. The portion of the cover member includes surfaces defining a notch therein for receiving a portion of a handle of the cup. The cover member is constructed and arranged to engage at least one end of the cup when the portion of the handle extends within the notch portion.

Other objects, features and characteristics of the present invention, as well as the methods of operation and the functions of the related elements of the structure, and the combination of the parts and economics of manufacture, will become more apparent upon consideration of the following detailed description and appended claims with reference to the accompanying drawings, all of which form a part of this specification.

DETAILED DESCRIPTION OF THE PRESENTLY PREFERRED EXEMPLARY EMBODIMENT

My improved handle structure improves upon a handle structure previously developed by me as noted above. Because my improved handle can be used with the coaster/cover structure previously provided with my original handle and includes several characteristics in common with my original structure, the disclosure of my original handle and accessories is included hereinbelow followed by a specific disclosure of my improved structure and its unique and advantageous attributes.

Figure 1:
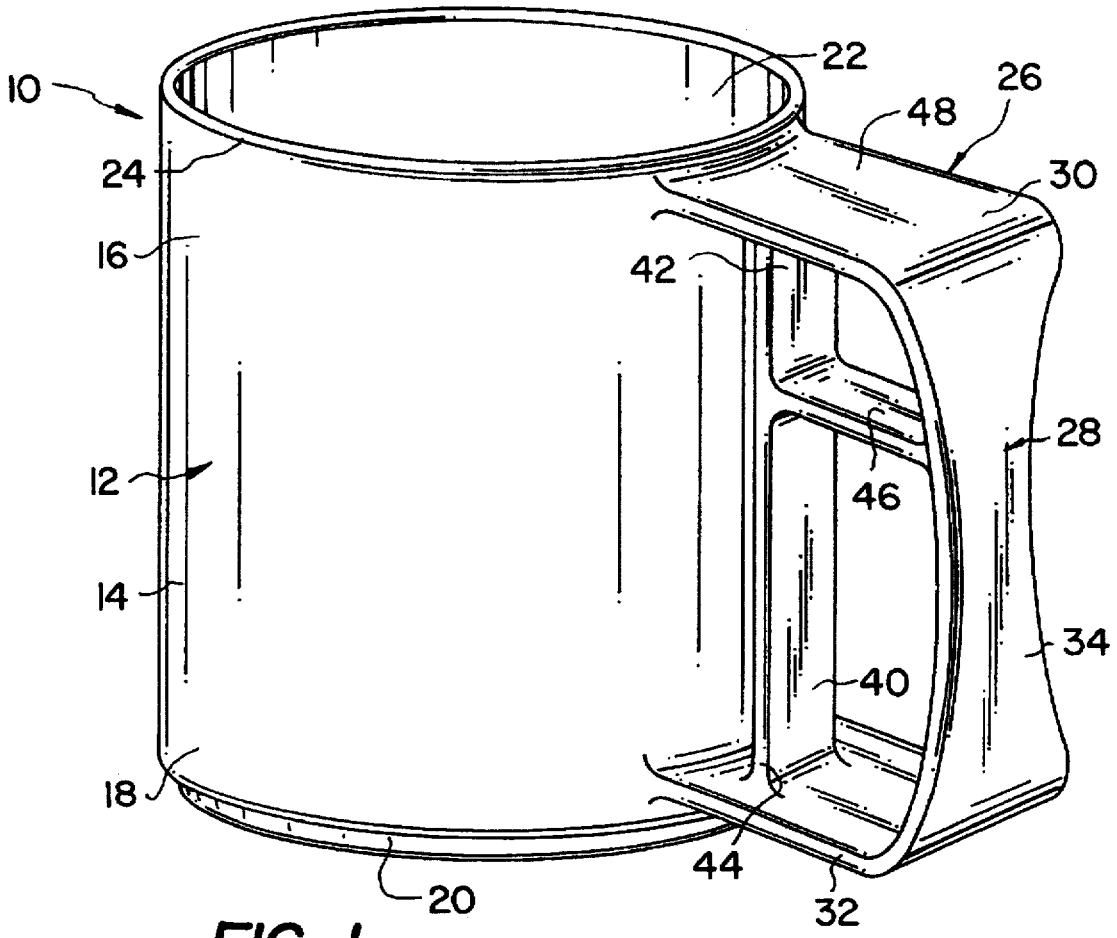
FIG. 1 is a perspective view of a cup constructed in accordance with the principles of my original improved handle structure.

Referring to FIG. 1, a cup is shown for housing liquid or the like, generally indicated at 10, which embodies the principles of the present invention. Cup 10 includes a main body 12 having a bottom end 14 and a top end 16 with sidewall structure 18 disposed between the bottom and top ends. The bottom end 14 defines a bottom surface 20 of the main body 12 while the top end 16 defines an opening 22 for the entry of a liquid or the like into the main body 12. The top end 16 terminates at rim 24. The reservoir of the main body 12 preferably has a capacity to contain, for example, 12 ounces of liquid, but greater and smaller volumes are contemplated as well. Cup main body 12, as shown, is cylindrical but it should be understood that other cross-sectional shapes could also be used including a square, an oval, or other multi-sided configurations such as octagonal and hexagonal.

The cup 10 includes a handle structure, generally indicated at 26, fixed to the sidewall 18. In the illustrated embodiment, the handle structure 26 includes a generally U-shape member 28 having an upper horizontal member 30 and an opposing lower horizontal member 32, each extending from the sidewall 18 with a generally vertical member 34 joining the ends of the horizontal members 30, 32 at a position spaced from the sidewall 18. In the illustrated embodiment, the horizontal members extend from the sidewall 18 approximately 1.5 inches and have a width of approximately 1.25 inches, the function of which will become apparent below. The vertical member 34 may have hour-glass shape with opposing arcuate outer surfaces 36, 38 that curve between horizontal members 30 and 32. Thus, the width of the vertical member 34 may gradually taper from the juncture of each horizontal members toward a central portion thereof. The arcuate outer surfaces 36, 38 facilitate gripping and balancing of the cup due to a better fit with the user's hand. This is especially so for users who have difficulty holding onto relatively small or thin handles. As an alternative to the concave hour-glass handle, a rectangular handle, a convex handle, or some other configuration may be provided.

Figure 2:
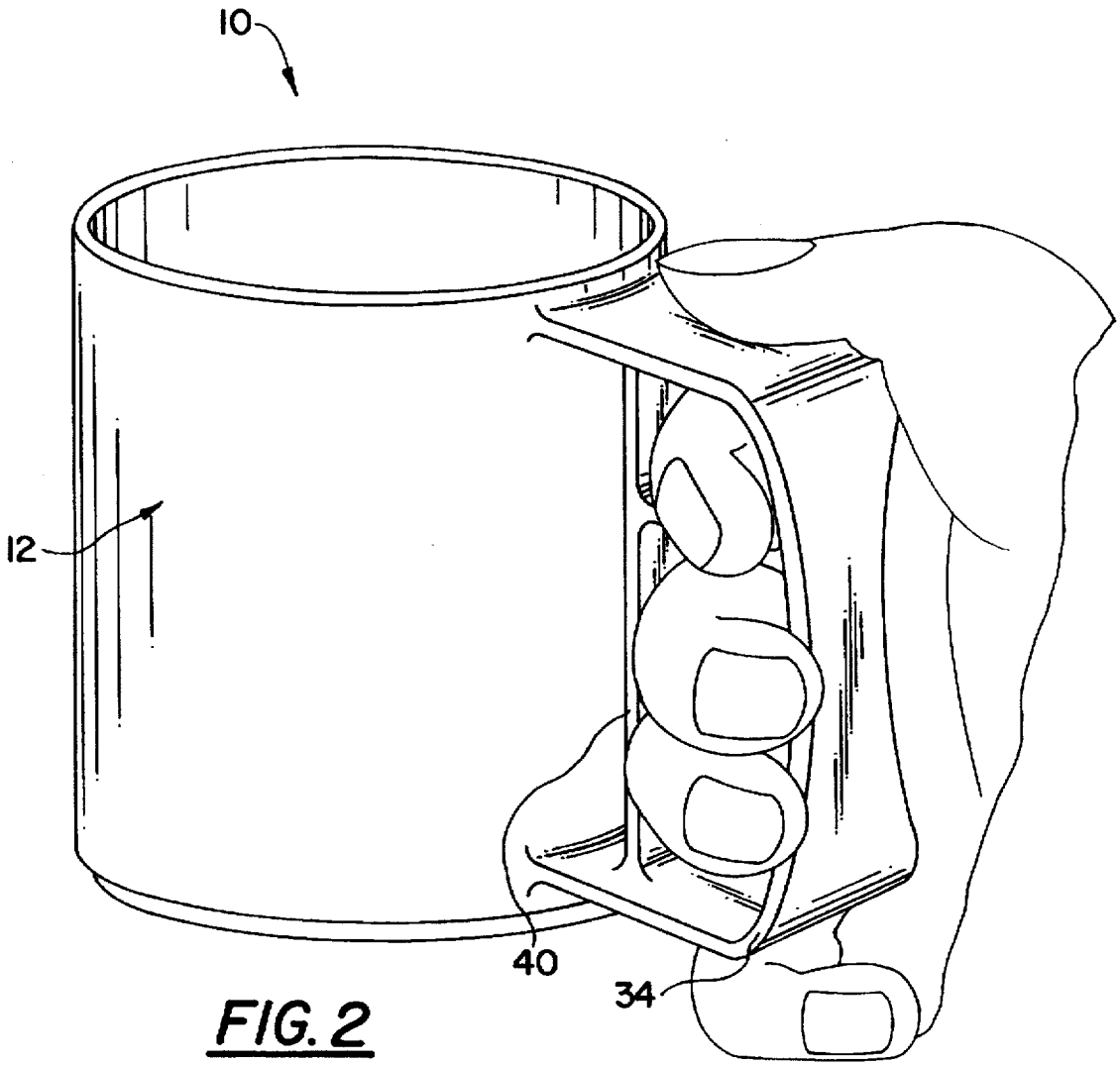
FIG. 2 is a perspective view of the cup of FIG. 1 shown being grasped by a user.

The handle structure 26 further includes a vertical plate 40 having a first end 42 and a second end 44. The first end 42 is coupled to the upper horizontal member 30 while the second end 44 of the vertical plate 40 is affixed to the lower horizontal member 32. As shown in FIG. 1, the vertical plate 40 is disposed between the sidewall 18 of the main body 12 and the vertical member 34 of the handle structure 26. The vertical plate 40 is disposed closer to the sidewall 18 than to the vertical member 34. Thus, a user's fingers may be disposed between the vertical plate 40 and the vertical member 34 of the handle structure 26. Further, as shown in FIG. 2, the vertical plate 40 isolates the user's fingers from contact with the sidewall 18 which may become extremely hot due to the contents of the main body 12.

In the illustrated embodiment, the handle structure 26 includes a horizontal plate 46 affixed between the vertical member 34 and the vertical plate 34. The horizontal plate 46 preferably has a width of approximately one-half inch, which is preferably equal to the width of the vertical plate 40. The horizontal plate 46 is disposed so as to be closer to the upper horizontal member 30 than to the lower horizontal member 32. Thus, when handling or gripping the cup 10, the user may insert his index finger through the space defined by the bounds of the upper horizontal member 30, the horizontal plate 46, the vertical plate 40 and vertical member 34, while two other fingers may be disposed in the space defined by the bounds of the lower horizontal member 32, the horizontal plate 46, the vertical plate and the vertical member 34, as shown in FIG. 2. The upper horizontal member 30 defines a planar surface 48 for resting the user's thumb to enhance lifting and balancing the cup 10. The lower horizontal member 32 has a similar planar surface. The horizontal plate also provides a surface for lifting. For example, a handicapped user having only a thumb and finger may lift the cup 10 by placing the thumb on the planar surface 48 of the upper horizontal member 30 and placing the finger so as to contact the underside of the horizontal plate 46.

The arcuate surfaces 36 and 38 of the vertical member 34 provide horizontal tilt control of the cup 10, since the shape facilitates secure contact with the user's fingers while requiring minimal grip strength.

Although in the illustrated embodiment, the horizontal plate 46 is disposed closer to the upper horizontal member 30, it can be appreciated, that the horizontal plate 46 may be disposed closer to the lower horizontal member 32 so that two of the user's fingers may be disposed above the horizontal plate 46 while a single finger may be disposed below the horizontal plate 46.

Figure 7:
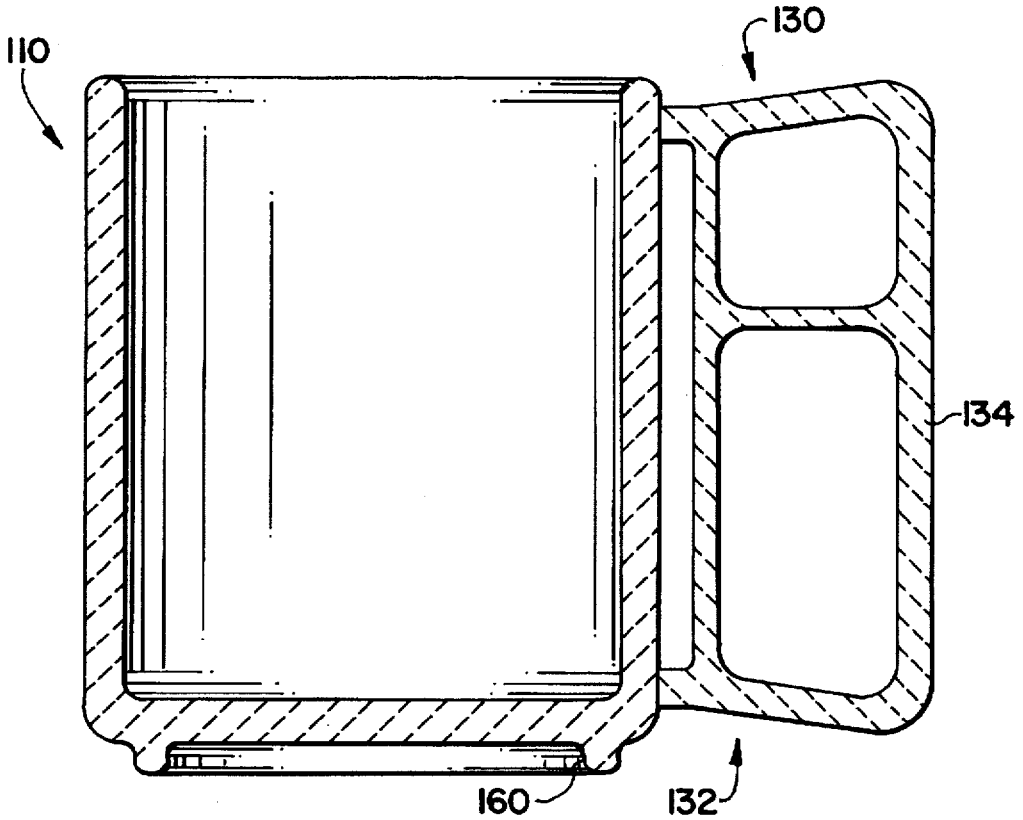
FIG. 7 is a schematic cross-sectional view of a cup and handle structure in accordance with the present invention.
Figure 8:
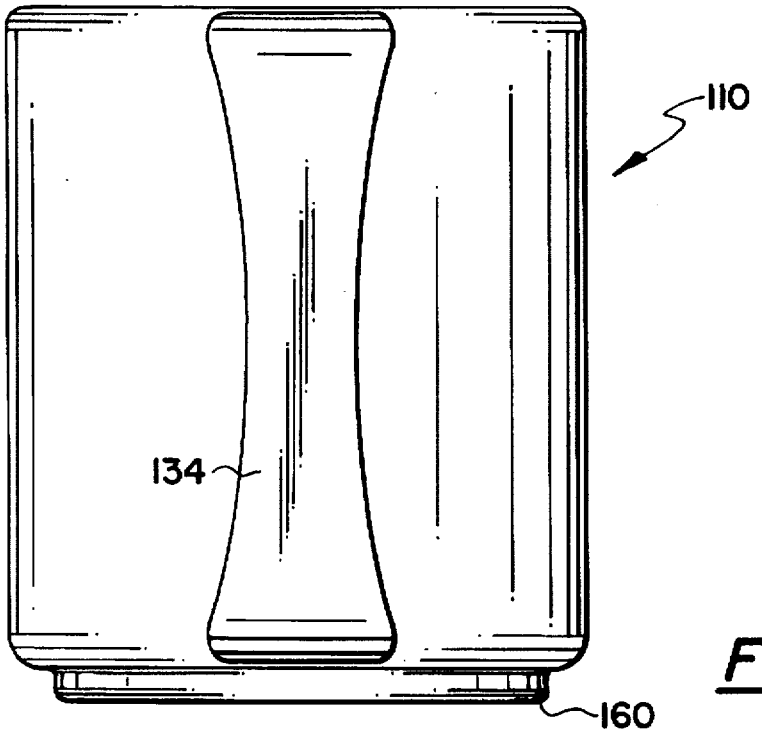
FIG. 8 is a side elevational view of a cup provided in accordance with the present invention.

In contrast to the horizontal members 30, 32 illustrated in FIGS. 1–2, in accordance with the present invention, illustrated in particular in FIG. 7, upper and lower portions or handle mounts 130, 132 are provided that are inclined with respect to horizontal so that they incline up and down, respectively, away from the main body of the cup 110, along at least a portion of their respective lengths. In the embodiment illustrated in FIG. 7, points of attachment of the upper and lower handle mounts are spaced further from the top and bottom ends of the cup body than the structure shown in FIGS. 1–2, so that the ends of the vertical member 134 of the handle do not project vertically beyond the horizontal planes of the top and bottom ends of the cup. In the currently preferred embodiment, the handle terminates with preferably at least about a 0.06" clearance so that the cup may be set rightside up or upside down without the handle contacting the surface on which the cup is placed. The provision of a base lip 160 further ensures the handle will be spaced from a tabletop or like surface. While the handle could terminate coincident with the planes of the ends of the cup main body (or the base lip) and thus also rest on a surface on which the cup is placed, it is envisioned that so providing the handle may increase the likelihood of the handle being chipped or broken and is therefore preferably avoided.

In accordance with the presently preferred embodiment, the upper handle mount is inclined at an angle of about 5°–15° and most preferably about 8° and the lower handle mount is inclined at an angle of about 5°–15° and most preferably about 8°. Further, in this embodiment the width of the handle is preferably somewhat less than that of my prior design, described above, being on the order of 1.0 inches.

Providing inclined handle mounts as shown provides significant advantages over the configuration of FIGS. 1–2. Indeed, so inclining the handle mount maximizes the size of the openings for the user's fingers and the length of the vertical member for the user to grip. The inclined upper and lower surfaces, furthermore, can be gripped by the thumb and/or pinky finger, for example. The inclined surface provides an opposing surface which may be more easily firmly grasped than a horizontal surface because the incline will resist slippage of the finger away from the main body of the cup. The inclined surface, furthermore, makes it easier for the user to comfortably hold the main cup body in a horizontal orientation by providing a surface against which the thumb can counterbalance the weight of the full cup.

Figure 3:
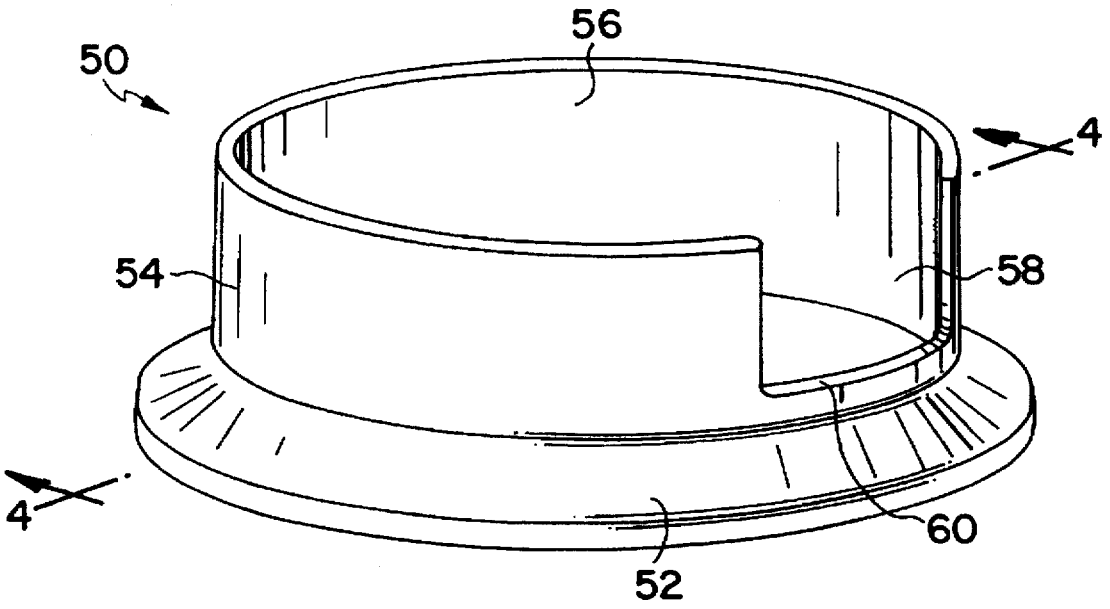
FIG. 3 is a perspective view of a cover member for the cup shown in FIG. 1.
Figure 4:
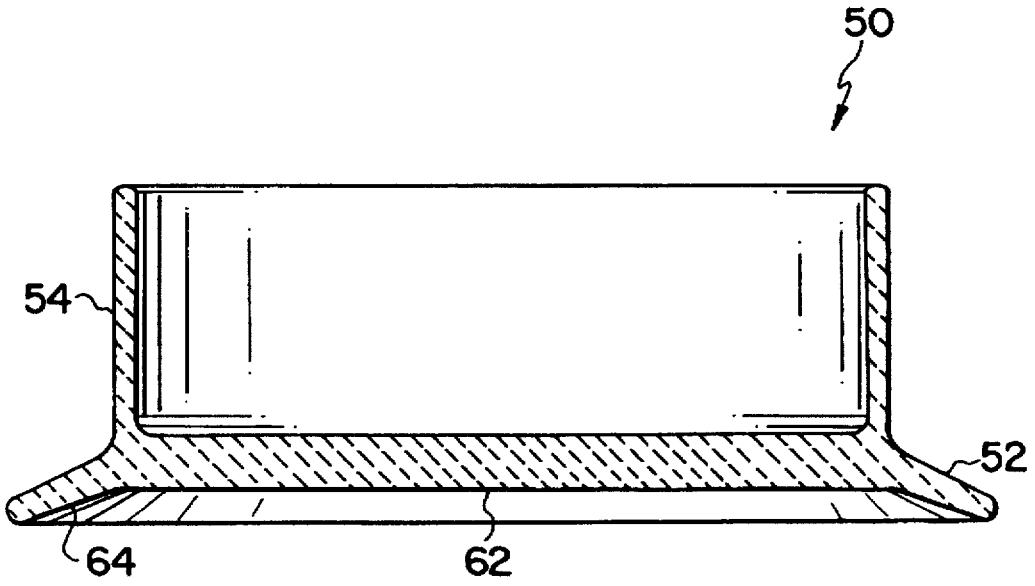
FIG. 4 is a cross-sectional view taken along the line 4—4 in FIG. 3.

As shown in FIGS. 3 and 4, a cover member, generally indicated at 50, may be used with the cup structures disclosed herein. The cover member 50 includes a base 52 and a generally cylindrical portion 54 fixed to the base 52 at one end thereof and extending approximately 1.25 inches from the base 52. The cylindrical portion 54 has an open end 56 for receiving the reservoir portion 12 of the cup 10. Thus, the inner periphery of the cylindrical portion 54 is larger than the outer periphery of the main body 12, so that a portion of the main body 12 may be received in the cylindrical portion 54 of the cover member 50. The cylindrical portion 54 includes surfaces defining a notch 58 therein. The notch 58 has a width larger than a width of the horizontal members 30, 32 of the handle structure 26. As shown in FIG. 3, surface 60 defining the bottom of the notch 58 extends from the base 52 a distance approximately 0.15 which has, the function of which will become apparent below. As shown in FIG. 4, the base 54 includes a planar surface 62 surrounded by a rim 64 which tapers from the planar surface 62 so as to define a dish-shaped structure.

Figure 5:
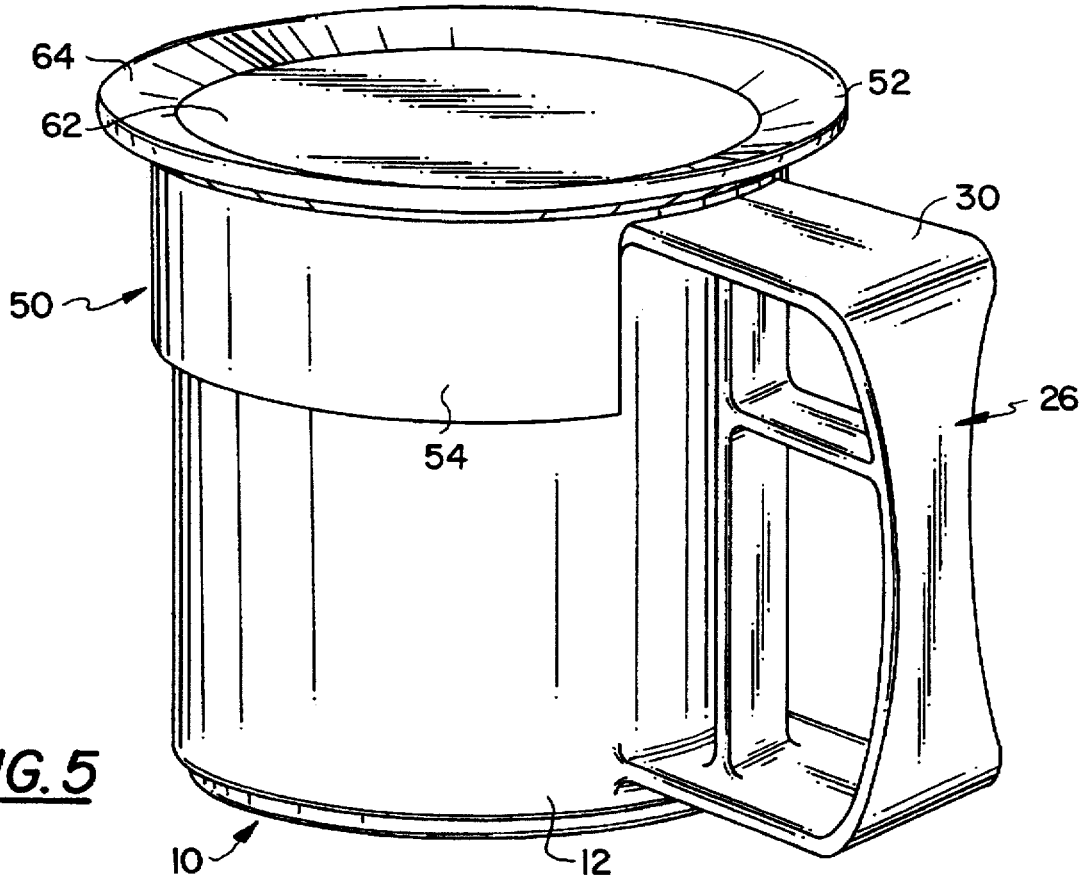
FIG. 5 is a perspective view of the cup of FIG. 1 shown with a cover member positioned over a top portion thereof.

As shown in FIG. 5, the cover member 50 is disposed over the opening 22 in the main body 12. Thus, the upper horizontal member 30 extends through the notch 58 and the rim 24 of the main body 12 contacts the underside of the base 52. In such a position, when the main body 12 is filled with a hot liquid, the cover member 50 prevents heat exchange between the liquid and air so that the liquid remains hot for a longer period of time. Further, the planar surface 62 and rim 64 of the base 50 defining the dish-shape may be used to rest food thereon so as to be warmed by heat transfer from the liquid in the cup 10 to the base 52 of the cover member 50. To facilitate heat transfer, the main body 12, handle structure 26 and cover member 50 are each composed of refractory material such as, for example, ceramic, stoneware or porcelain. However, each could be formed from other material including wood, metal or man-made materials including plastics, thermoforming or thermosetting resins.

Figure 6:
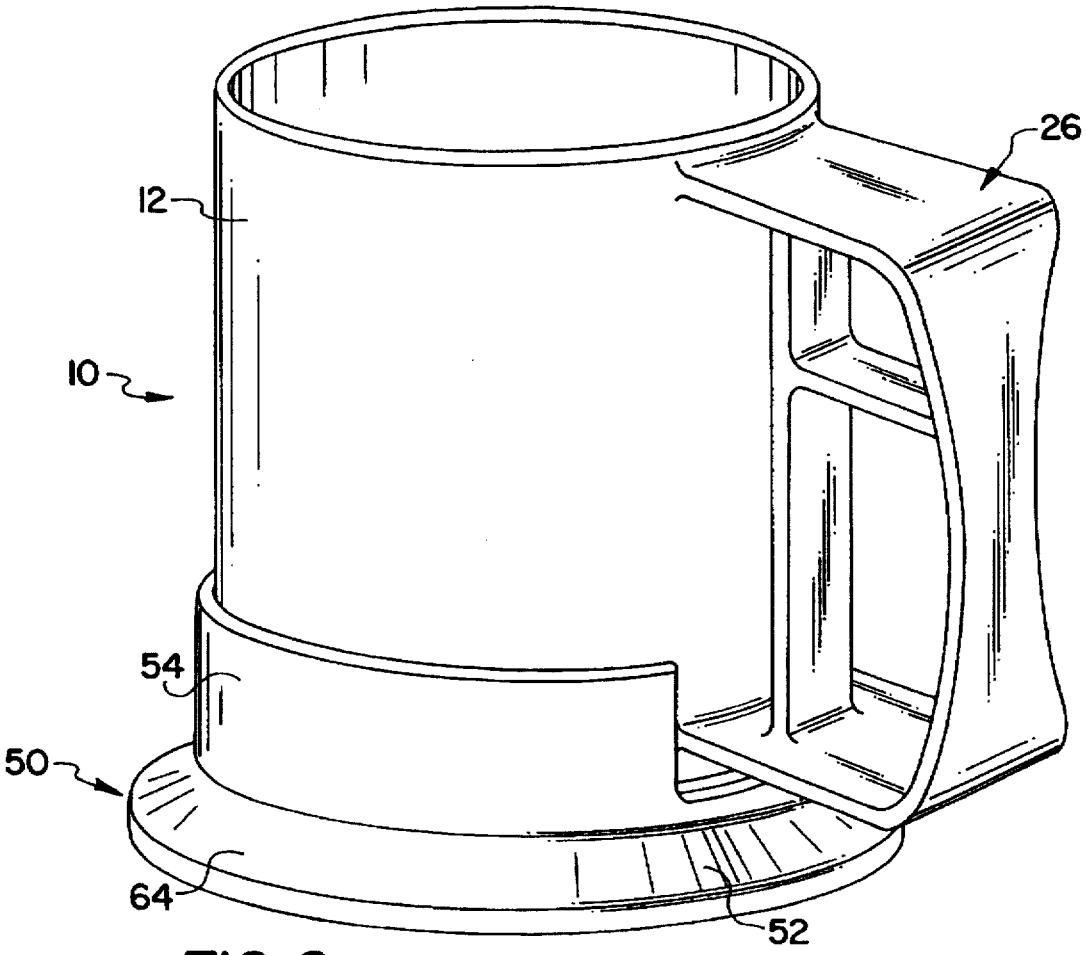
FIG. 6 is a perspective view of the cup of FIG. 1 shown with the cover member positioned under the bottom portion thereof.

As shown in FIG. 6, the cup 10 is shown placed in the cover member 50 so that the bottom surface 20 of the main body 12 contacts the underside of the base 52 of the cover member 50. The surface 60 defining the bottom of the notch 58 extends from the base 52 so that if liquid within the main body 12 inadvertently spills therefrom, the liquid will be contained within the cylinder portion 54 of the cover member 50. Thus, in this position, the cover member 50 functions as a coaster to contain spills.

As is apparent from the foregoing, the handle illustrated in FIGS. 1–6 horizontal handle mounts 30 and 32.

It has thus been seen that the present invention provides a cup having an improved handle structure whereby users having disabilities may lift and balance the cup easily. Thus, regardless of how weak, inflexible or otherwise limited the user's hands may be, the cup of the invention is configured so that the weight thereof may be supported by the handle structure so that the user may simply balance and lift the cup without strain from the hands. Further, the cup provides a barrier which isolates the user's fingers from contact with the hot outer periphery of the cup containing a liquid at an elevated temperature.

While the invention has been described in connection with what is presently considered to be the most practical and preferred embodiment, it is understood that the invention is not limited to the disclosed embodiment but, on the contrary, is intended to cover various modifications and equivalent arrangements included within the spirit and scope of the appended claims.

What is claimed is:

1. A cup comprising:

a main body having bottom and top ends and an interconnecting sidewall structure, said bottom end defining a closed bottom surface of said main body, said top end defining an opening to a reservoir in said main body, and a handle structure affixed to said main body, said handle structure including:

upper and lower handle portions, each having proximal and distal ends, said proximal ends of said upper and lower handle portions each being fixed to said sidewall of said main body so that said upper and lower handle portions extend outwardly from said sidewall, said lower handle portion having upper and lower generally flat, parallel surfaces, said lower handle portion being inclined with respect to horizontal so as to extend downwardly away from said main body along at least a portion of a length of said lower handle portion, whereby said upper and lower parallel surfaces of said lower handle portion are both inclined downwardly along said inclined portion of said lower handle;

a generally vertical portion spaced from said sidewall structure and extending between and joining said upper and lower handle portions;

a plate member fixed to at least one of said upper and lower handle portions and extending generally vertically along at least a substantial portion of a distance between said upper and lower handle portions and spaced from said sidewall structure; and a generally horizontal plate element coupled to and extending between said plate member and said vertical portion.

2. The cup as defined in claim 1, wherein said plate member is connected to each of said upper and lower handle portions.

3. The cup as defined in claim 1, wherein said plate member is generally parallel to said vertical portion, a lateral distance from said plate member to said sidewall structure being less than a lateral distance from said plate member to said vertical portion.

4. The cup as defined in claim 1, wherein said main body is of generally cylindrical shape.

5. The cup as defined in claim 1, wherein said horizontal plate is disposed closer to said upper handle portion than to said lower handle portion.

6. The cup as defined in claim 1, wherein said upper and lower handle portions extend from said sidewall structure a distance of approximately 1.5 inches.

7. The cup as defined in claim 6, wherein said first portion and said second portion each have a width of approximately 1.00 inches defining a planar surface.

8. The cup as defined in claim 1, wherein said plate member is spaced approximately 0.20 inches from said sidewall structure and has a width of about 0.5 inches.

9. The cup as defined in claim 1, wherein said plate member is generally rectangular.

10. The cup as defined in claim 1, wherein a width of said vertical portion gradually tapers from each of the upper and lower handle portions toward a central portion of said vertical portion.

11. The cup as defined in claim 10, wherein said taper is defined by arcuate edges.

12. The cup as defined in claim 1, wherein said main body and said handle structure are integrally made in one piece from refractory material.

13. The cup as defined in claim 1, wherein said upper handle portion is inclined with respect to horizontal so as to extend upwardly away from said main body, along at least a portion of a length of said upper handle portion.

14. The cup as defined in claim 1, wherein said lower handle portion is inclined at an angle of about 5°–15° to horizontal.

15. The cup as defined in claim 1, in combination with a cover member, said cover member comprising:

a base, a wall portion extending generally perpendicularly from said base to define an open ended receiver chamber, an inner periphery of said wall portion of said cover member being greater than an outer periphery of said main body so that at least a part of said main body may be received in said receiver chamber of said cover member, said wall portion of said cover member having a notch defined therein, said notch having a width larger than a width of each of said first and second portions of said handle structure, said cover member being constructed and arranged to be selectively mounted to either said bottom end or said top end of said main body, with a respective one of said first and second portions received by said notch portion and at least a portion of said main body received in said receiver chamber, whereby the cover member selectively defines a lid or a saucer for the cup.

16. The combination as defined in claim 15, wherein a surface defining a bottom of said notch is spaced from said base.

17. The combination as defined in claim 15, wherein said cover member is made from refractory material.

18. The combination as defined in claim 15, wherein said base of said cover member includes a planar surface and a rim portion.

19. The combination as defined in claim 15, wherein said portion of said cover member and said main body are both generally cylindrical.

20. The cup as defined in claim 1, wherein said main body and said handle structure are integrally made in one piece from a plastic material.

* * * * *